US008410704B1

(12) United States Patent
Cooley et al.

(10) Patent No.: US 8,410,704 B1
(45) Date of Patent: Apr. 2, 2013

(54) IONIZATION DEVICE

(75) Inventors: James Edward Cooley, San Francisco, CA (US); Sameer Kothari, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 13/307,641

(22) Filed: Nov. 30, 2011

(51) Int. Cl.
*H01J 49/14* (2006.01)
*H01J 49/10* (2006.01)
*H05H 1/00* (2006.01)

(52) U.S. Cl. ..... 315/111.21; 315/111.81; 250/423 P; 250/423 R; 250/424; 356/316; 438/513

(58) Field of Classification Search ..... 250/423 P, 250/423 R, 424; 315/111.21, 111.81; 356/316; 438/513
See application file for complete search history.

(56) References Cited

U.S. PATENT DOCUMENTS

| | | | | |
|---|---|---|---|---|
| 6,806,651 | B1 * | 10/2004 | Chistyakov | 315/111.21 |
| 7,750,575 | B2 * | 7/2010 | Chistyakov | 315/111.21 |
| 2003/0070913 | A1 * | 4/2003 | Miller et al. | 204/192.1 |
| 2011/0109226 | A1 | 5/2011 | Cooley et al. | |

OTHER PUBLICATIONS

Eschner, et al. "Quasi-Simultaneous Acquisition of Hard Electron Ionization and Soft Single-Photon Ionization Mass Spectra during GC/MS Analysis by Rapid Switching between Both Ionization Methods: Analytical Concept, Setup, and Application on Diesel Fuel", Anal. Chem. 2011, 83, 3865-3872.

* cited by examiner

*Primary Examiner* — Nikita Wells

(57) ABSTRACT

Ionization devices that have at least two modes of ionization, and that can switch between these two modes of operation, are described. Illustratively, the ionization devices can switch between a photoionization (PI) mode and a combined mode of electroionization (EI) and PI (EI/PI mode).

20 Claims, 4 Drawing Sheets

IONIZATION DEVICE

BACKGROUND

Photoionization (PI) involves directing light of desired wavelengths to an unknown gas sample to induce ionization. PI may be used to facilitate examination of the composition of the unknown gas sample via photochemistry applications such as soft ionization and photo-fragmentation. For example, light from the vacuum ultraviolet (VUV) region of the electromagnetic spectrum is particularly useful in PI applications applications because the energies of VUV photons (generally 6 eV-124 eV) correspond to electronic excitation and ionization energies of most chemical species.

Electron impact ionization (EI) involves directing electrons having a desired kinetic energy at an unknown gas sample to induce ionization and fragmentation of molecules of the sample gas.

Fragmentation by EI is often referred to as "hard" ionization. By contrast, a PI source functions as a "soft" ionization source because sample molecules are less fragmented than when EI sources are used. Less fragmentation of molecules provided by a PI source can produce molecular ion signals to a greater extent than known EI sources.

While the comparatively lesser extent of fragmentation provided by PI sources is useful in certain applications such as the identification of unknown compounds, the fragmentation pattern produced by an EI source provides information that is often useful, but that may not be realized by photo-fragmentation with a PI source.

What is needed, therefore, are ionization devices and methods of use that allows for selective ionization by EI and PI.

BRIEF DESCRIPTION OF THE DRAWINGS

The representative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DEFINED TERMINOLOGY

Figure 1:
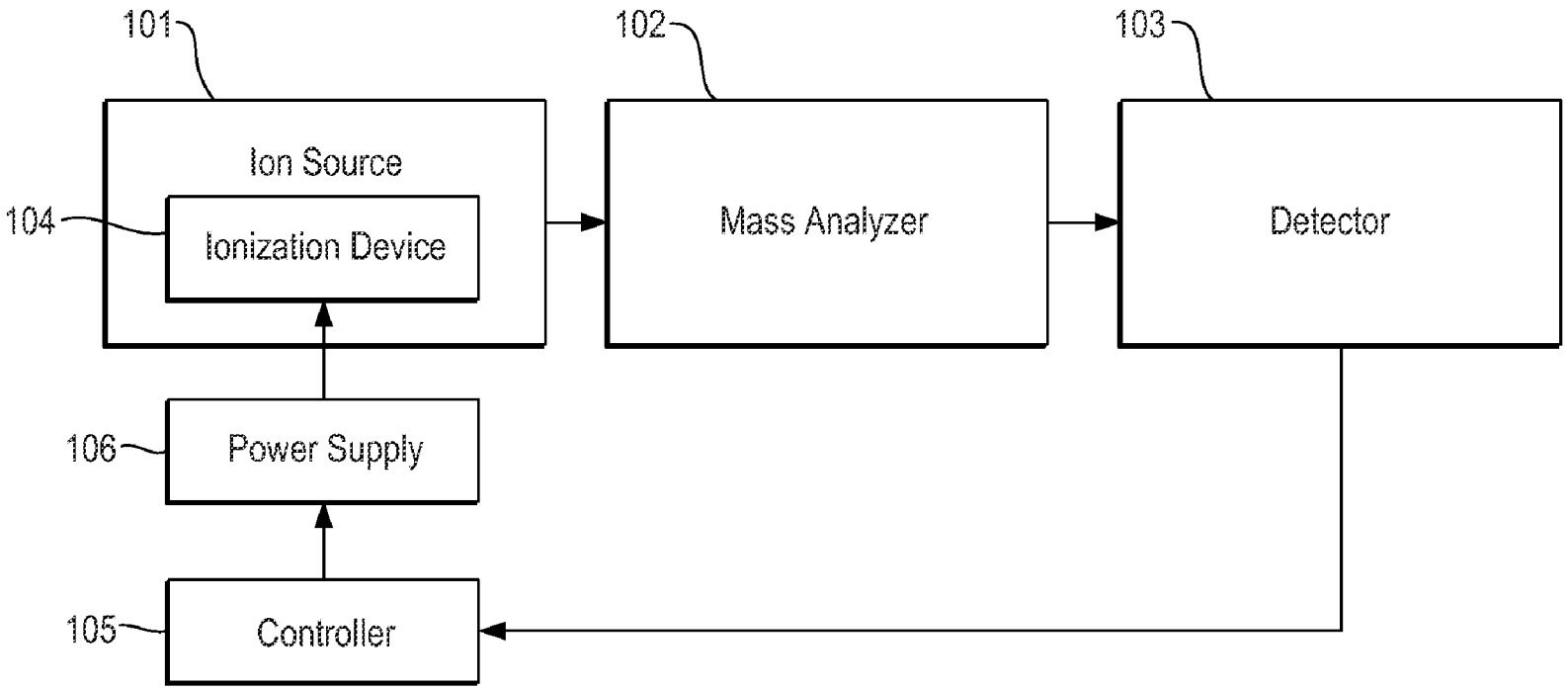
FIG. 1 illustrates a simplified schematic view of a mass spectrometer in accordance with a representative embodiment.

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable in the context of the present teachings.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known devices, materials and manufacturing methods may be omitted so as to avoid obscuring the description of the example embodiments. Nonetheless, such devices, materials and methods that are within the purview of one of ordinary skill in the art may be used in accordance with the representative embodiments described below. Further, it is understood that the various configurations of electrical components and connections depicted in the figures are illustrative, and therefore may vary without departing from the scope of the present teachings.

It is understood that relative terms as may be used herein, such as "above," "below," "top," "bottom," "upper," "lower," "left," "right," "vertical" and "horizontal," are used to describe the various elements' relationships to one another, as illustrated, in the accompanying drawings. It is understood that these relative terms are intended to encompass different orientations of the device and/or elements in addition to the orientation depicted in the drawings. For example, if the device were inverted with respect to the view in the drawings, an element described as "above" another element, for example, would now be "below" that element. Likewise, if the device were rotated 90 degrees with respect to the view in the drawings, an element described as "vertical," for example, would now be "horizontal."

Generally, and as described more fully in connection with representative embodiment, the present teachings relate to ionization devices that have at least two modes of ionization, and can switch between these two modes in a comparatively short duration of time (e.g., 1 millisecond to 9 milliseconds or less). For example, the present invention provides an ionization device that can quickly switch between a photoionization (PI) mode and a combined mode of electroionization (EI) and PI (EI/PI mode). Illustratively, the ionization device of the present teachings is contemplated for use in a mass spectrometer, among other applications that would be apparent to one of ordinary skill in the art having the benefit of the present disclosure.

In a representative embodiment, an ionization device comprises a plasma source configured to generate a plasma. The plasma comprises light, plasma ions and plasma electrons. The ionization device further comprises: a plasma deflection device disposed between the plasma source and an ionization region; and an electron acceleration device disposed between the plasma source and the ionization region. The plasma deflection device and the electron acceleration device are configured to establish a first electric field during a first time interval and to establish a second electric field during a second time interval. The first electric field substantially prevents plasma electrons and plasma ions from entering the ionization region, while allowing the light to reach the ionization region. The second electric field substantially prevents plasma ions from entering the ionization region, while allowing the light to reach the ionization region.

In another representative embodiment, a method of exposing a sample gas to an ionization source in an ionization region is disclosed. The method allows for exposing the sample gas selectively to EI or EI/PI ionization. The method comprises: generating a plasma comprising light, plasma ions and plasma electrons; establishing a first electric field during a first time interval to substantially prevent plasma electrons and plasma ions from entering the ionization region; and establishing a second electric field during a second time interval to accelerate plasma electrons toward the ionization region and to substantially prevent plasma ions from entering the ionization region.

FIG. 1 shows a simplified schematic diagram of a mass spectrometer 100 in accordance with a representative embodiment. The block diagram is drawn in a more general format because the present teachings may be applied to a variety of different types of mass spectrometers. As should be appreciated as the present description continues, devices and methods of representative embodiments may be used in connection with the mass spectrometer 100. As such, the mass spectrometer 100 is useful in garnering a more comprehensive understanding of the functions and applications of the devices and method of the representative embodiments, but is not intended to be limiting of these functions and applications.

The mass spectrometer 100 comprises an ion source 101, a mass analyzer 102 and a detector 103. The ion source 101 comprises an ionization device 104, which is configured to ionize a gas sample (not shown in FIG. 1) and to provide ions to the mass analyzer 102. Details of ionization device 104 are described in accordance with representative embodiments below. Other components of the mass spectrometer 100 comprise apparatuses known to one of ordinary skill in the art and are not described in detail to avoid obscuring the description of representative embodiments. For example, the mass analyzer 102 may be a quadrupole mass analyzer, an ion trap mass analyzer, or a time-of-flight (TOF) mass analyzer, among other types of mass analyzers, and the detector 103 may be one of a number of known detectors used in mass spectrometers.

A controller 105 is connected between the detector 103 and a power supply 106, which is connected to the ionization device 104. As described more fully below, among other functions, the controller 105 is configured to control the magnitude and duration of voltages applied by the power supply 106 to electrodes (not shown in FIG. 1) of the ionization device 104 to allow the selection of the ion source 101 to be a PI source, or to be an EI/PI source depending on the desired spectral data.

In accordance with a representative embodiment, based on control signals from the controller 105, the power supply 106 is configured to selectively apply a direct current (DC) voltage, or a time dependent (AC) voltage, or both, to electrodes (not shown in FIG. 1) of the ionization device 104. In one representative embodiment, based on signals from controller 105, the power supply 106 is configured to selectively apply a DC voltage, or a time dependent square wave voltage with a DC offset value to electrodes of the ionization device 104.

As described more fully below, the selective application of voltages to the electrodes of the ionization device 104 results in the establishment of a first electric field during a first time interval that substantially prevents plasma electrons and plasma ions from entering an ionization region of the ionization device 104; and the establishment of a second electric field during a second time interval that accelerates plasma electrons toward the ionization region and substantially prevents plasma ions from entering the ionization region. Accordingly, during the first time interval, only plasma photons reach the ionization region of the ionization device 104, whereas during the second time interval both plasma photons and plasma electrons are permitted to reach the ionization region, with the electrons being accelerated by the second electric field. Thus, in the first time interval the ionization device 104 functions as a PI device, and in the second time interval, the ionization device 104 functions both as a PI device and as an EI device.

More generally, and beneficially, the user can program the controller 105 to provide signals to the power supply 106 so that the ionization device 104 functions as a PI device (sometimes referred to herein as PI mode) allowing only PI of a sample for a particular interval of time. In another interval of time the user can program the controller 105 to provide signals to the power supply 106 so that the ionization device 104 functions as both a PI device and as an EI device (sometimes referred to herein as EI/PI mode) allowing both PI and EI of a sample for a particular interval of time. As such, a user can coordinate a collection of PI data during the first time interval and a collection of both PI data and EI ionization data during the second time interval. Moreover, according to the present teachings, the user can program the controller 105 to provide signals to the power supply 106 so ionization device 104 can switch between EI mode and EI/PI mode in a comparatively short duration of time (e.g., 1 millisecond to 9 milliseconds or less).

Controller 105 can be implemented in whole or in part by a processing device, such as a processor or central processing unit (CPU), application specific integrated circuits (ASICs), field-programmable gate arrays (FPGAs), or combinations thereof, using software, firmware, hard-wired logic circuits, or combinations thereof. Details of certain aspects of the functions of controller 105 are provided below in connection with the representative embodiments. In some embodiments, controller 105 is implemented on a real-time operating system (OS) used in the mass spectrometer 100 or as a standalone device. When using a processor or CPU, a memory (not shown) is included for storing executable software/firmware and/or executable code that controls the signal from controller 105 to ionization device 104. The memory may be any number, type and combination of nonvolatile read only memory (ROM) and volatile random access memory (RAM), and may store various types of information, such as computer programs and software algorithms executable by the processor or CPU. The memory may include any number, type and combination of tangible computer readable storage media, such as a disk drive, an electrically programmable read-only memory (EPROM), an electrically erasable and programmable read only memory (EEPROM), a CD, a DVD, a universal serial bus (USB) drive, and the like.

Figure 2:
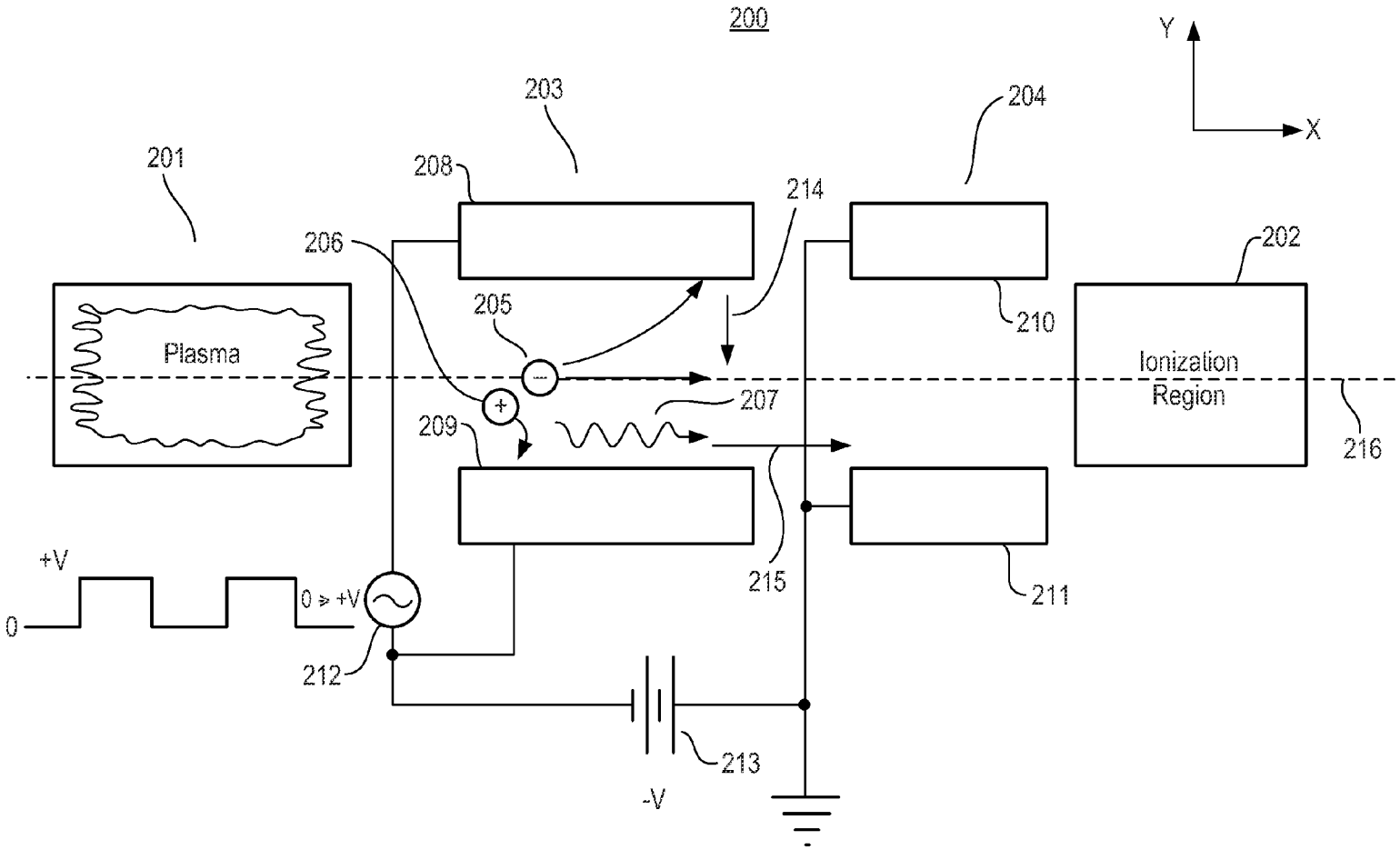
FIG. 2 illustrates a simplified schematic view of an ionization device in accordance with a representative embodiment.

FIG. 2 illustrates a simplified schematic view of an ionization device 200 in accordance with a representative embodiment. The ionization device 200 may be implemented in the ion source 101 as the ionization device 104. The ionization device 200 comprises a plasma source 201 and an ionization region 202. In accordance with a representative embodiment, the plasma source 201 is a VUV source where VUV light is generally defined as light having wavelengths in the range of 10 nm-200 nm. Illustratively, the plasma source 201 may be a plasma source such as described in commonly-owned U.S. patent application Ser. No. 12/613,643, entitled "Microplasma Device with Cavity for Vacuum Ultraviolet Irradiation of Gases and Methods of Making and Using the Same" to James E. Cooley, et al. The disclosure of this patent application, which is published, as U.S. Patent Application Publication 20110109226, is specifically incorporated herein by reference.

A plasma deflection device 203 and an electron acceleration device 204 are provided in tandem between the plasma source 201 and the ionization region 202. In the embodiment depicted in FIG. 2, the plasma deflection device 203 is disposed immediately next to the plasma source 201 and the electron acceleration device 204 is disposed immediately next to the ionization region 202. It is noted that the ordering of the plasma deflection device 203 and the electron acceleration device 204 may be "switched." In this alternate configuration, the plasma deflection device 203 is disposed immediately next to the ionization region 202 and the electron acceleration device 204 is disposed immediately next to the plasma source 201. If this alternative configuration is selected, the connections to the time dependent voltage source (described below) and the static voltage source (described below) would differ from the configuration depicted in FIG. 2.

As described more fully below, in one mode of operation, the plasma deflection device 203 and the electron acceleration device 204 are configured to operate in concert to selectively deflect plasma electrons 205 and plasma ions 206 to substantially prevent the plasma electrons 205 and the plasma ions 206 from reaching the ionization region 202, and allowing only plasma photons 207 to reach the ionization region 202. In another mode of operation, the plasma deflection device 203 and the electron acceleration device 204 are configured to operate in concert to selectively deflect plasma ions 206 and to accelerate plasma electrons 205 toward the ionization region 202 while allowing plasma photons 207 to reach the ionization region 202. In the former mode of operation, only plasma photons 207 reach the ionization region 202, and the ionization device 200 functions as a PI device. In the latter mode of operation, both plasma electrons 205 and plasma photons 207 reach the ionization region 202, and the ionization device 200 functions as both a PI device and as an EI device (EI/PI device).

The plasma deflection device 203 comprises a first deflection electrode 208 and a second deflection electrode 209. Similarly, the electron acceleration device 204 comprises a first acceleration electrode 210 and a second acceleration electrode 211. The plasma deflection device 203 is connected to a time dependent voltage source 212 that is configured to apply a time dependent voltage having a maximum voltage +V and a minimum voltage of 0V. The electron acceleration device 204 is connected to a static (DC) voltage source 213 that provides a voltage (negative) −V. Based on control signals from the controller 105, the power supply 106 can be configured to function alternately as the time dependent voltage source 212 and as the static voltage source 213. As such, the various potential differences described above, and their resultant electric fields, can be selectively applied in both a time dependent manner and in a static manner by the controller 105.

The time variation of the voltage output from the time dependent voltage source 212 results in the ionization device 200 functioning as an EI device, and as an EI/PI device in a time dependent manner.

In particular, because of the depicted electrical connection of the respective electrodes of the plasma deflection device 203 and the electron acceleration device 204, the first and second deflection electrodes 208, 209 are biased negatively relative to the first and second acceleration electrodes 210, 211, which are tied together and to ground as shown in FIG. 2.

When the potential difference between the first and second deflection electrodes 208, 209 is large (i.e., +V), a first electric field 214 is established in a direction (y-direction in the coordinate system depicted) that is orthogonal to an axis 216 between the plasma source 201 and the ionization region 202. As a result of this first electric field 214, plasma electrons 205 are deflected to the first deflection electrode 208, and plasma ions 206 are deflected to the second deflection electrode 209. As such, in this configuration, only plasma photons 207 reach the ionization region 202 and the ionization device 200, functions only as a PI device.

By contrast, when first and second deflection electrodes 208, 209 are at the same potential (i.e., 0 V), the relative bias (−V) between the plasma deflection device 203 and the electron acceleration device 204 establishes a second electric field 215 that is parallel to the axis 216 (x-direction in the coordinate system depicted). As a result of the second electric field 215, plasma electrons 205 are accelerated in the x-direction, and plasma ions 206 are repelled in the −x direction in the coordinate system depicted. As such, in this configuration, both plasma electrons 205 and plasma photons 207 reach the ionization region 202, and the ionization device 200 functions as an EI/PI device.

Notably, with the ionization device 200 configured to function as an EI/PI device, the plasma electrons 205 are accelerated by the second electric field 215 and achieve an energy of |V| eV upon exit from the electron acceleration device 204. In certain applications, it is useful to provide 70 eV electrons to the sample, so |V|=70V. It is emphasized that the selection of |V|=70V, and that the energy of the plasma electrons 205 can be selected merely by the selection of the relative bias (i.e., −V) between the plasma deflection device 203 and the electron acceleration device 204.

As can be appreciated from a review of FIG. 2 and its accompanying description above, the first and second acceleration electrodes 210, 211 as biased are configured to isolate the ionization region 202 from the electric potentials of the first and second deflection electrodes 208, 209, the electric potential of the plasma, and any space charge in the plasma deflection device 203. Beneficially, this isolation of the ionization region 202 from the electric potentials established by the first and second deflection electrodes 208, 209, allows for optimized potential profiles to extract the sample beam and direct the sample beam into the mass analyzer 102. In particular, the isolation of the ionization region 202 allows for the formation of comparatively low energy ion beam.

In certain embodiments, the time dependent voltage provided by the time dependent voltage source 212 approximates a square wave with a minimum voltage (0 V) and the maximum voltage (+V). As should be appreciated by one of ordinary skill in the art, data collected during the transition of the time dependent voltage between the minimum voltage (0 V) and the maximum voltage (+V) is of little value. As such, it is beneficial for the rise time and fall time of the time dependent voltage provided by the time dependent voltage source 212 to be small compared to the period of the time dependent voltage provided by the time dependent voltage source 212.

The illustrative square wave voltage applied by the time dependent voltage source 212 can be selected to be periodic or to be non-periodic. When a periodic square wave voltage signal is provided to the plasma deflection device 203, the ionization device 200 functions alternately as an EI source, and as an EI/PI for equal time intervals. Similarly, when a non-periodic square wave voltage signal is provided to the plasma deflection device 203, the ionization device 200 functions alternately as an EI source and as an EI/PI for unequal time intervals.

The selection of the time interval during which the ionization device 200 functions as a PI device only or as an EI/PI device can be set by programming of the controller 105, which in turns controls the output voltage of the power supply 106. More generally, the controller 105 can be programmed to select the magnitude and duration of voltages applied to the first and second deflection electrodes 208, 209 and to the first and second acceleration electrodes 210, 211.

The ability to select both the magnitude and duration of the voltages applied to the first and second deflection electrodes 208, 209, and to the first and second acceleration electrodes 210, 211, allows the user many options with the ionization device 200. The ability to select the time dependence of the voltages applied by the time dependent voltage source 212 provides further advantages over known ionization devices. For example, because EI/PI mode is a more efficient ionization mode than EI mode alone, according to certain embodiments the time intervals may be selected to be unequal to substantially balance the differences in the efficiencies of ionization between the two ionization modes.

Direct injection of a sample into a mass spectrometer that includes an EI source is known. However, because the filaments used in known EI sources are inherently fragile in high pressure environments that are typical during introduction of solvent vapor, only solid or dried samples are typically analyzed this way. Furthermore, the highly complex fragmentation spectrum that EI generates can make identification of individual components in a chemical mixture difficult, so samples usually need to be separated first, (e.g., by gas chromatography), before ionization.

The ionization device 200 uses a restricted flow scheme in which the gas in the plasma source 201 operates at higher pressure than its surrounding environment. Plasma gas and other energetic plasma products (including ultraviolet light) are vented into the vacuum environment of the ionization region 202 where the ionization reactions take place. The plasma itself is thus isolated from the ionization region 202 and is substantially insensitive to changes in pressure or composition there. As such, and among other advantages of the ionization device 200, the sample can be injected directly into the ionization region 202, and the plasma is unaffected by the increase in pressure due to vaporized solvent common during direct sample injection.

Additionally, the soft ionization reactions caused by the UV light of the plasma or other energetic products generate molecular ion peaks and/or greatly reduced fragmentation for many compounds. This makes analysis of overlapping spectra in an unseparated chemical mixture much easier than would be realized with known EI source alone, especially when coupled with a high resolution mass spectrometer.

Figure 3:
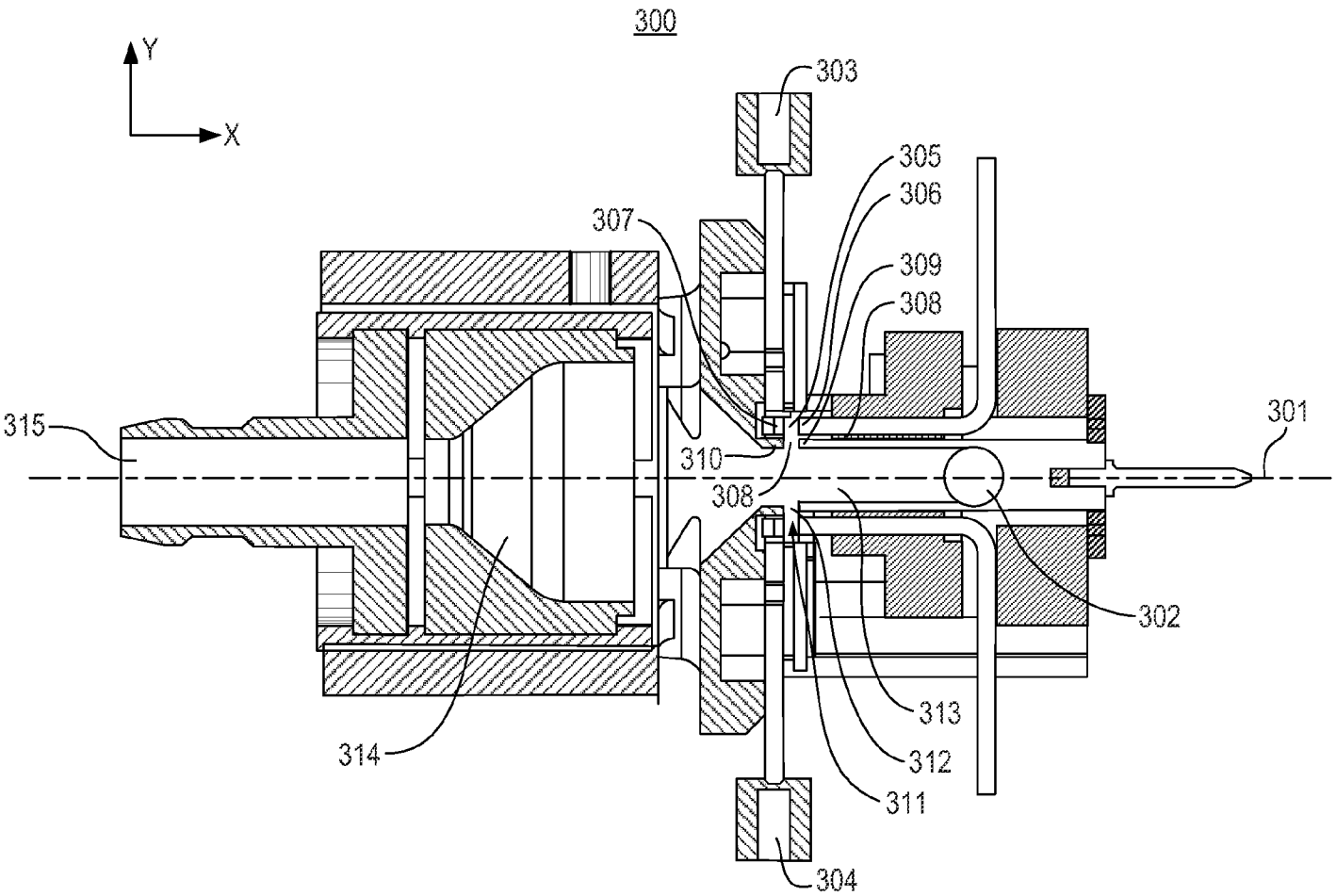
FIG. 3 illustrates a cross-sectional view of an ionization device in accordance with a representative embodiment.

FIG. 3 illustrates a cross-sectional view of an ionization device 300 in accordance with a representative embodiment. The ionization device 300 may be implemented in the ion source 101 as the ionization device 104. The ionization device 300 is disposed around an axis of symmetry 301. An inlet 302 is provided and is configured to receive a sample gas (not shown) comprising analyte molecules. The sample gas is directed at the inlet 302 in a direction parallel to the axis of symmetry 301. Many details of the ionization device 300 are common to the ionization device 200 and are not repeated in order to avoid obscuring the teachings of the presently described embodiments.

The various components of the ionization device 300 that are usefully electrically conducting are made of a suitable electrically conductive material such as stainless steel. The various components of the ionization device 300 that are required to be electrically insulating are made of a suitable electrical insulator such as a high-temp plastic (e.g., Vespel®), or a suitable machinable ceramic material (e.g., Macor®, alumina or boron nitride).

The ionization device 300 comprises a first plasma source 303 and, optionally, a second plasma source 304. The first and second plasma sources 303, 304 are illustratively as described in U.S. Patent Application Publication 20110109226, incorporated by reference above. Notably, the second plasma source 304 provides a redundant function to the first plasma source 303 and its function is not described in further detail.

The ionization device 300 comprises a first plasma deflection device 305 disposed adjacent to an aperture through which light from a plasma is transmitted. The first plasma deflection device 305 comprises a first deflection electrode 306 and a second deflection electrode 307. The ionization device 300 also comprises a first electron acceleration device 308 comprising a first acceleration electrode 309 and a second acceleration electrode 310. In the event that the optional second plasma source 304 is implemented, a second plasma deflection device 311 and a second electron acceleration device 312, with respective sets of deflection electrodes and acceleration electrodes as depicted, are provided.

The first and second deflection electrodes 306, 307 of the first plasma deflection device 305 are selectively connected to a time dependent voltage source such as a power supply (e.g., power supply 106). Similarly, the first and second acceleration electrodes 309, 310 of the first electron acceleration device 308 are selectively connected to a static (DC) voltage source voltage source such as a power supply (e.g., power supply 106). In a manner similar to that described above in connection with FIG. 2, a controller (e.g., controller 105) is provided for the selective application of the time dependent voltage and the static voltage. As such, the first plasma deflection device 305 is connected to a time dependent voltage source that is configured to apply a time dependent voltage having a maximum voltage (e.g., +V) and a minimum voltage (e.g., 0V). Similarly, the first electron acceleration device 308 is connected to a static (DC) voltage source that provides a voltage (e.g., −V).

In a representative embodiment, the time dependent voltage provided approximates a square wave with a minimum voltage (e.g., 0 V) and a maximum voltage (e.g., +V). As described more fully above, voltages are selectively applied to the first and second deflection electrodes 306, 307 and to the first and second acceleration electrodes 309, 310 to selectively establish a first electric field (in the x-direction of the coordinate system shown in FIG. 3) and a second electric field (in the −y direction of the coordinate system shown in FIG. 3).

The selective application of a time dependent voltage to the first and second deflection electrodes 306, 307 and to the first and second acceleration electrodes 309, 310 results in selective deflection of electrons away from an ionization region 313 or the acceleration of electrons toward an ionization region 313. As such, the ionization device 300 is configured to function as a PI device (electrons deflected) or an EI/PI device (electrons accelerated.)

Although not depicted in FIG. 3, the present teachings contemplate the incorporation of a magnetic field to aid in confining electrons in the ionization region 313. For example, this optional magnetic field may be established by the selective location of permanent magnets, such as permanent rare-earth magnets disposed adjacent to the ionization region 313.

After ionization, analyte ions are directed by ion optics 314 toward an outlet 315 and to a mass analyzer (not shown in FIG. 3).

Figure 4:
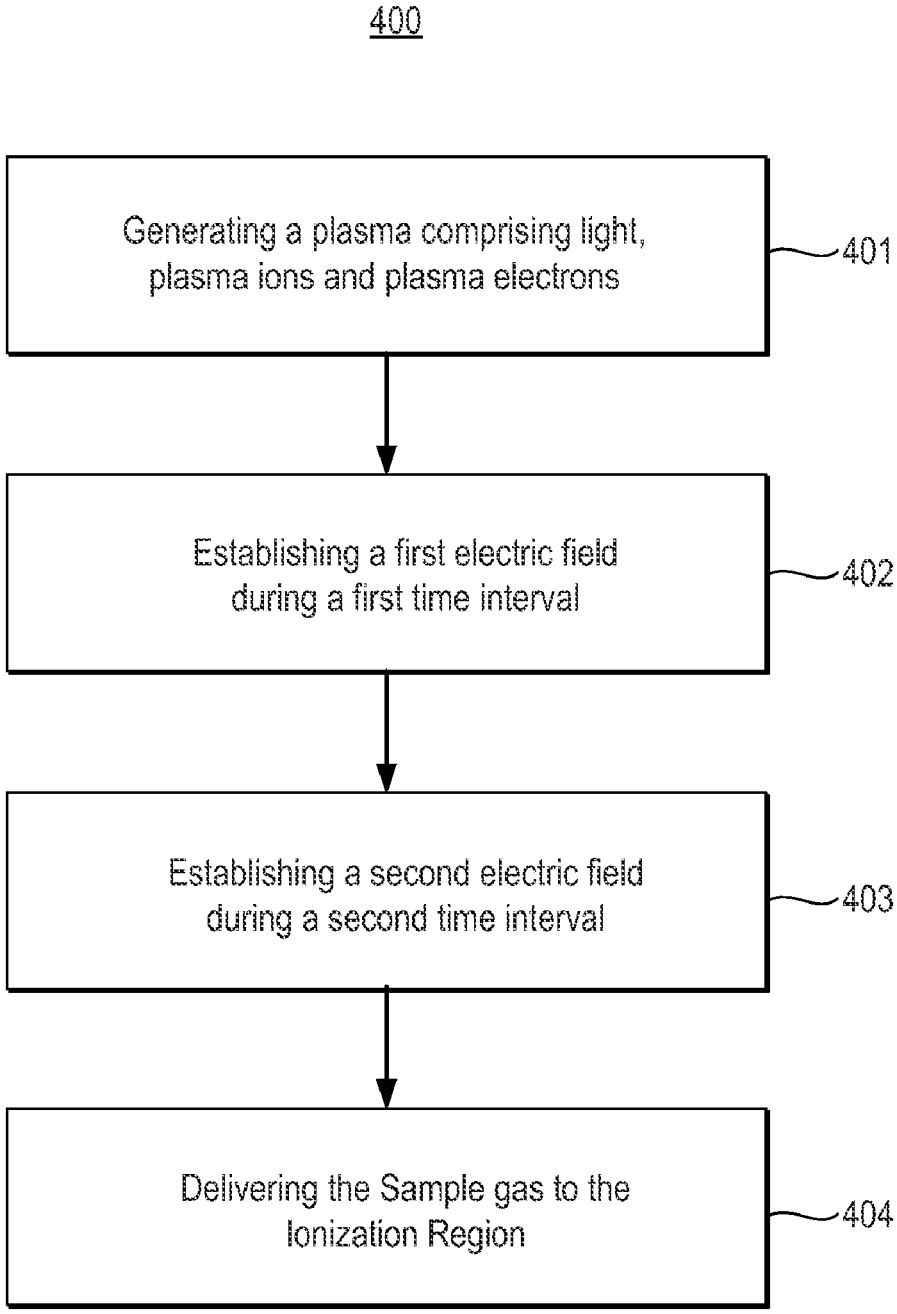
FIG. 4 illustrates a flow chart of a method of exposing a sample gas to an excitation light in accordance with a representative embodiment.

FIG. 4 illustrates a flow chart of a method 400 of exposing a sample gas in an ionization region to an ionization source. The method 400 may be implemented using the ionization devices according to representative embodiments described in connection with FIGS. 1~3. At 401, the method comprises generating a plasma comprising light, plasma ions and plasma electrons. At 402, the method comprises establishing a first electric field between a deflection device and an acceleration device. The first electric field substantially prevents plasma electrons and plasma ions from entering the ionization region. At 403, the method comprises establishing a second electric field between the deflection device and the acceleration device during a second time interval to accelerate plasma electrons toward the ionization region and to substantially prevent plasma ions from entering the ionization region. At 404, the method comprises delivering the sample gas to the ionization region.

While representative embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. An ionization device, comprising:

a plasma source configured to generate a plasma, the plasma comprising light, plasma ions and plasma electrons;

a plasma deflection device disposed between the plasma source and the ionization region; and an electron acceleration device disposed between the plasma source and an ionization region, the plasma deflection device and the electron acceleration device being configured to establish a first electric field during a first time interval and to establish a second electric field during a second time interval, wherein the first electric field substantially prevents plasma electrons and plasma ions from entering the ionization region while allowing the light to reach the ionization region, and the second electric field substantially prevents plasma ions from entering the ionization region, while allowing the light to reach the ionization region.

2. An ionization device as claimed in claim 1, wherein the first electric field is substantially orthogonal to an axis between the plasma source and the ionization region.

3. An ionization device as claimed in claim 1, wherein the second electric field is substantially parallel to an axis between the plasma source and the ionization region.

4. An ionization device as claimed in claim 1, further comprising means for applying a time dependent voltage to the electron acceleration device and means for applying a direct current (DC) voltage to the plasma deflection device.

5. An ionization device as claimed in claim 4, wherein the time dependent voltage is approximately a square wave voltage having a period substantially equal to a sum of the first time interval and the second time interval.

6. An ionization device as claimed in claim 5, wherein a duration of the first time interval is substantially the same as a duration of the second time interval.

7. An ionization device as claimed in claim 5, wherein the ionization device operates in PI mode during the first time interval and in EI/PI mode during the second time interval.

8. An ionization device as claimed in claim 1, wherein the plasma deflection device is disposed between the plasma source and the ionization region and the electron acceleration device is disposed between the plasma deflection device and the ionization region.

9. An ionization device as claimed in claim 1, wherein the electron acceleration device is disposed between the plasma source and the ionization region and the plasma deflection device is disposed between the electron acceleration device and the ionization region.

10. A mass spectrometer, comprising a mass analyzer, a detector and an ion source, wherein the ion source comprises the ionization device of claim 1.

11. A mass spectrometer as claimed in claim 10, further comprising:

a controller configured to coordinate a collection of photoionization data during the first time interval and a collection of both photoionization data and electron impact ionization data during the second time interval.

12. A mass spectrometer as claimed in claim 10, further comprising:

a power supply selectively connected between the controller, and the plasma deflection device and the electron acceleration device, wherein the power supply is configured to apply a voltage to the plasma deflection device and the electron acceleration device to create the first electric field and the second electric field.

13. A mass spectrometer as claimed in claim 12, wherein the power supply is configured to apply a time dependent voltage to the electron acceleration device and to apply a direct current (DC) voltage to the plasma deflection device.

14. A method of exposing a sample gas in an ionization region to an ionization source, the method comprising:

generating a plasma comprising light, plasma ions and plasma electrons;

establishing a first electric field during a first time interval to substantially prevent plasma electrons and plasma ions from entering the ionization region while allowing the light to reach the ionization region;

establishing a second electric field during a second time interval to accelerate plasma electrons toward the ionization region and to substantially prevent plasma ions from entering the ionization region while allowing the light to reach the ionization region; and delivering the sample gas to the ionization region.

15. A method as claimed in claim 14, wherein the first electric field is substantially orthogonal to an axis of symmetry.

16. An method as claimed in claim 14, wherein the second electric field is substantially parallel to an axis of symmetry.

17. A method as claimed in claim 14, wherein the establishing the first electric field comprises applying a time dependent voltage.

18. A method as claimed in claim 17, wherein the establishing the second electric field comprises applying a direct current (DC) voltage.

19. A method as claimed in claim 14, wherein the method further comprises:

coordinating a collection of photoionization data during the first time interval.

20. A method as claimed in claim 19, wherein the method further comprises:

coordinating a collection of photoionization data and electron impact ionization data during the second time interval.

* * * * *